US008757387B2

(12) United States Patent
Makino et al.

(10) Patent No.: US 8,757,387 B2
(45) Date of Patent: Jun. 24, 2014

(54) CLASSIFICATION DEVICE

(75) Inventors: Nobuyasu Makino, Numazu (JP); Masakazu Yashiro, Shizuoka-ken (JP); Kazuo Kuratani, Sakai (JP)

(73) Assignee: Ricoh Company, Limited, Tokyo (JP)

( * ) Notice: Subject to any disclaimer, the term of this patent is extended or adjusted under 35 U.S.C. 154(b) by 489 days.

(21) Appl. No.: 12/629,430

(22) Filed: Dec. 2, 2009

(65) Prior Publication Data

US 2010/0072115 A1 Mar. 25, 2010

(30) Foreign Application Priority Data

Dec. 3, 2008 (JP) ..... 2008-308889

(51) Int. Cl.
*B07B 7/00* (2006.01)
*B07B 7/04* (2006.01)

(52) U.S. Cl.
USPC ..... 209/139.1

(58) Field of Classification Search
USPC ..... 209/139.1
See application file for complete search history.

(56) References Cited

U.S. PATENT DOCUMENTS 1,934,406 A * 11/1933 Coe ..... 209/161
2,638,219 A * 5/1953 Gordon et al. ..... 209/139.2
3,367,502 A * 2/1968 Cravens ..... 209/467
3,929,293 A * 12/1975 Hahn et al. ..... 241/42
4,857,178 A * 8/1989 Barthelmess ..... 209/143
5,103,981 A * 4/1992 Abbott et al. ..... 209/37
5,205,415 A * 4/1993 Surtees ..... 209/21
5,476,109 A * 12/1995 Coleman et al. ..... 131/109.2
5,575,824 A * 11/1996 Brown et al. ..... 44/505
5,798,025 A * 8/1998 Iwashige ..... 162/261
5,957,299 A * 9/1999 Keuschnigg et al. ..... 209/135
5,994,016 A 11/1999 Kuramoto et al.
6,033,722 A * 3/2000 Koike et al. ..... 427/58
6,171,448 B1 * 1/2001 Iwashige ..... 162/380
6,286,771 B1 * 9/2001 Brown et al. ..... 241/162
6,318,561 B1 * 11/2001 Zampini et al. ..... 209/714

(Continued)

FOREIGN PATENT DOCUMENTS

JP 4-243582 A 8/1992
JP 2001-293438 10/2001

(Continued)

OTHER PUBLICATIONS

Office Action issued Sep. 4, 2012, in Japanese Patent Application No. 2008-308889.

*Primary Examiner* — Stefanos Karmis
*Assistant Examiner* — Michael E Butler
(74) *Attorney, Agent, or Firm* — Oblon, Spivak, McClelland, Maier & Neustadt, L.L.P.

(57) ABSTRACT

A classification device for classifying particles by size including an upper impeller-type rotor, a first end of which is covered with a cover disc without penetration hole and a second end of which is covered with an upper cover disc with a penetration hole; and a lower impeller-type rotor, a first end of which is covered with a cover disc without penetration hole and a second end of which is covered with a lower cover disc with a penetration hole. The upper impeller-type rotor and the lower impeller-type rotor are provided so that axes thereof are coincident and the first ends face with each other forming a gap therebetween in an axial direction, and the diameters of the penetration holes of the upper cover disc and the lower cover disc are different.

17 Claims, 5 Drawing Sheets

(56) References Cited

U.S. PATENT DOCUMENTS

| | | | | |
|---|---|---|---|---|
| 6,368,765 | B2 | 4/2002 | Izu et al. | |
| 6,503,681 | B2 | 1/2003 | Makino et al. | |
| 6,575,391 | B1 * | 6/2003 | Brown et al. | 241/60 |
| 6,586,151 | B1 * | 7/2003 | Naka et al. | 430/137.2 |
| 6,613,490 | B2 * | 9/2003 | Matsunaga et al. | 430/109.3 |
| 7,032,849 | B2 | 4/2006 | Takahashi et al. | |
| 7,318,990 | B2 | 1/2008 | Makino et al. | |
| 7,358,024 | B2 * | 4/2008 | Naka et al. | 430/137.2 |
| 7,498,114 | B2 | 3/2009 | Makino et al. | |
| 7,866,582 | B2 * | 1/2011 | Nied | 241/5 |
| 2003/0000869 | A1 * | 1/2003 | Morales Tirado et al. | 209/142 |
| 2003/0178514 | A1 | 9/2003 | Makino et al. | |
| 2005/0003294 | A1 | 1/2005 | Murakami et al. | |
| 2006/0063091 | A1 * | 3/2006 | Makino et al. | 430/110.4 |
| 2006/0214036 | A1 | 9/2006 | Makino | |
| 2006/0222980 | A1 | 10/2006 | Makino et al. | |
| 2008/0227022 | A1 | 9/2008 | Noge et al. | |
| 2009/0206008 | A1 | 8/2009 | Makino et al. | |
| 2012/0280071 | A1 * | 11/2012 | Manola | 241/43 |

FOREIGN PATENT DOCUMENTS

| | | |
|---|---|---|
| JP | 2002-126651 A | 5/2002 |
| JP | 2004-198640 | 7/2004 |
| JP | 2006-293268 | 10/2006 |
| JP | 2008-26457 | 2/2008 |
| JP | 2008-161823 | 7/2008 |
| WO | WO 2004/088431 A1 | 10/2004 |

* cited by examiner

CLASSIFICATION DEVICE

BACKGROUND OF THE INVENTION

1. Field of the Invention

The present invention relates to a classification device for classifying toner particles for use in image forming methods such as electrophotography, electrostatic recording, electrostatic printing, and toner jet recording.

2. Discussion of the Background

Methods of manufacturing toner are broadly divided into pulverization methods and polymerization methods. A typical pulverization method includes, for example, processes of mixing a binder resin (for fixing a toner on a recording medium) and a colorant (for providing the toner with a color), optionally along with additives such as a charge controlling agent (for providing the toner with chargeability), a magnetic material (for providing the toner with transportability), a release agent, and a fluidizer; melt-kneading the mixture; cooling and solidifying the melt-kneaded mixture; pulverizing the solidified mixture into fine particles; classifying the fine particles by size and collect desired-size particles; and mixing the collected particles with an external additive to obtain a toner. Such a toner is generally used for image forming. The toner may be further mixed with a magnetic carrier to be used for two-component developing methods.

Recent toners have a small particle diameter for high-definition printing while including a low-melting point binder resin and a release agent (such as a wax) for high-speed printing. Such toner particles having a particle diameter of 2 μm or less generally have poor heat-resistant storage stability, and are likely to cause the problems called "background fouling" and "filming". "Background fouling" is a phenomenon in which the background portion of an image is disadvantageously soiled with toner particles. "Filming" is a phenomenon in which toner particles disadvantageously form thin film thereof on a photoreceptor, etc. Therefore, it is better to remove toner particles having a particle diameter of 2 μm or less from the resultant toner.

FIG. 1 is an explanatory diagram illustrating exemplary processes for manufacturing a toner. A material 41 to be pulverized is repeatedly subjected to a closed-circuit pulverization process in a pulverization device 42 equipped with a classification device for removing coarse particles so that coarse particles larger than desired-size particles are repeatedly subjected to pulverization. The pulverization device 42 may be an airflow-type pulverizer or a mechanical pulverizer, for example. The material 41 which have been pulverized into particles are classified into desired-size particles 44 and fine particles 45 by a classification device 43. The classification device 43 may be a multisegment airflow-type classifier or a vertical air diverter, for example.

Classification devices for manufacturing toners are divided into impeller types and non-impeller types. Impeller-type classification devices include what is called a tandem toner separator (hereinafter "TTSP"), which is one of wind power classifiers. A typical TTSP performs classification by balancing centrifugal force generated from blades provided on a rotor and centripetal force generated from fan suction force of the rotor. The centrifugal force collects coarse particles, whereas the centripetal force collects fine particles from the periphery of the rotor. A typical TTSP includes a single casing, within which two impeller-type classification rotors are provided with one end of each of which being supported. The impeller-type classification rotors are capable of being driven by a motor, and the axes thereof are coincident. The first end of each of the classification rotors in the axial direction is covered with a cover disc without penetration hole, and the second end thereof is equipped with a cover disc with a penetration hole for discharging fine particles or middle-size particles. The two classification rotors are provided so that the surfaces of the first ends thereof face with each other. As a result, a minute drift space is formed therebetween in the axial direction.

To respond to recent demands for high image quality, a small-size toner with a narrow size distribution is sought because such a toner provides good dot reproducibility. Dots formed with such a small-size toner are unlikely to vary even after developing or transfer processes. Therefore, a toner manufacturing apparatus is demanded which can accurately classify particles by size, in other words, which can remove particles with a particle diameter of 2 μm or less and collect particles with a particle diameter of from 3 to 4 μm so that a resultant toner has an average particle diameter of about 5 μm with a high yield.

Additionally, toners are simultaneously required to be fixable at low temperatures from the viewpoint of reduction of consumption energy, to include a low-softening-point binder resin from the viewpoint of color mixing, and to include a release agent to be applicable to oilless fixing processes. Such toners may have adhesion or fusion property.

In particular, such a toner having the above-described properties and a particle diameter with 2 μm or less have poor heat-resistant storage stability, and are likely to cause the problems of background fouling and filming. Therefore, a classification device which can remove toner particles with a particle diameter of 2 μm or less is demanded.

A conventional TTSP has a problem that desired-size toner particles with a particle diameter of from 3 to 4 μm are also removed along with fine particles when the maximum peripheral speed of the rotor is about 65 m/s, especially when the toner particles are for use in two-component development or non-magnetic one-component development. This is because the weight of such toner particles is very small.

Even if the classification device disclosed in Japanese Patent Application Publication No. 2008-026457 is improved so that the rotor can rotate at a peripheral speed of 70 m/s or more, it is likely that toner particles as final products adhere to the spiral member due to centrifugal force generated by the rotor. Further, because the outlet part provided on the base of the outlet short pipe is narrow, emission efficiency is also reduced due to adhesion and fusion of the toner particles to the outlet part.

When a TTSP operates continuously, the following problems may arise.

1) Particles with a particle diameter of from 3 to 4 μm are classified into fine particles in large quantity and removed from the resultant product toner, resulting in deterioration of toner yield;
2) Toner particles stagnate and adhere to the inner surface of a spiral member. The adhered toner particles release therefrom and are immixed in the resultant product toner; and
3) The residence time of toner particles in a classification chamber is destabilized due to adhesion of toner particles, resulting in deterioration of classification accuracy.

Japanese Patent Application Publications Nos. 2004-198640, 2001-293438, 2006-293268 and 2008-161823, and International Patent Application Publication No. WO2004/088431 each disclose a classification device or a method of manufacturing toner using a classification device. However, these classification devices or methods are required to more improve their classification accuracy.

SUMMARY OF THE INVENTION

Accordingly, an object of the present invention is to provide a classification device which reliably classifies toner particles by size with high efficiency and high yield without causing adhesion of toner particles.

These and other objects of the present invention, either individually or in combinations thereof, as hereinafter will become more readily apparent can be attained by a classification device for classifying particles by size, comprising:

an upper impeller-type rotor, a first end of which is covered with a cover disc without penetration hole and a second end of which is covered with an upper cover disc with a penetration hole; and a lower impeller-type rotor, a first end of which is covered with a cover disc without penetration hole and a second end of which is covered with a lower cover disc with a penetration hole;

wherein the upper impeller-type rotor and the lower impeller-type rotor are provided so that axes thereof are coincident and the first ends face with each other forming a gap therebetween in an axial direction, and wherein diameters of the penetration holes of the upper cover disc and the lower cover disc are different.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
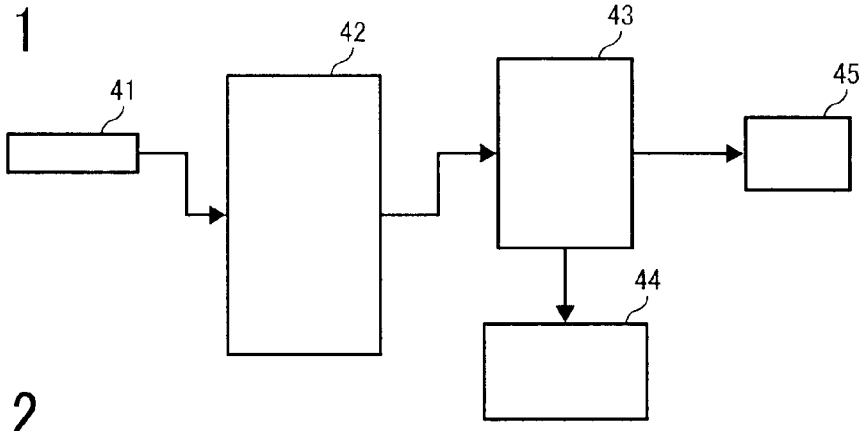
FIG. 1 is an explanatory diagram illustrating exemplary processes for manufacturing a toner.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 2:
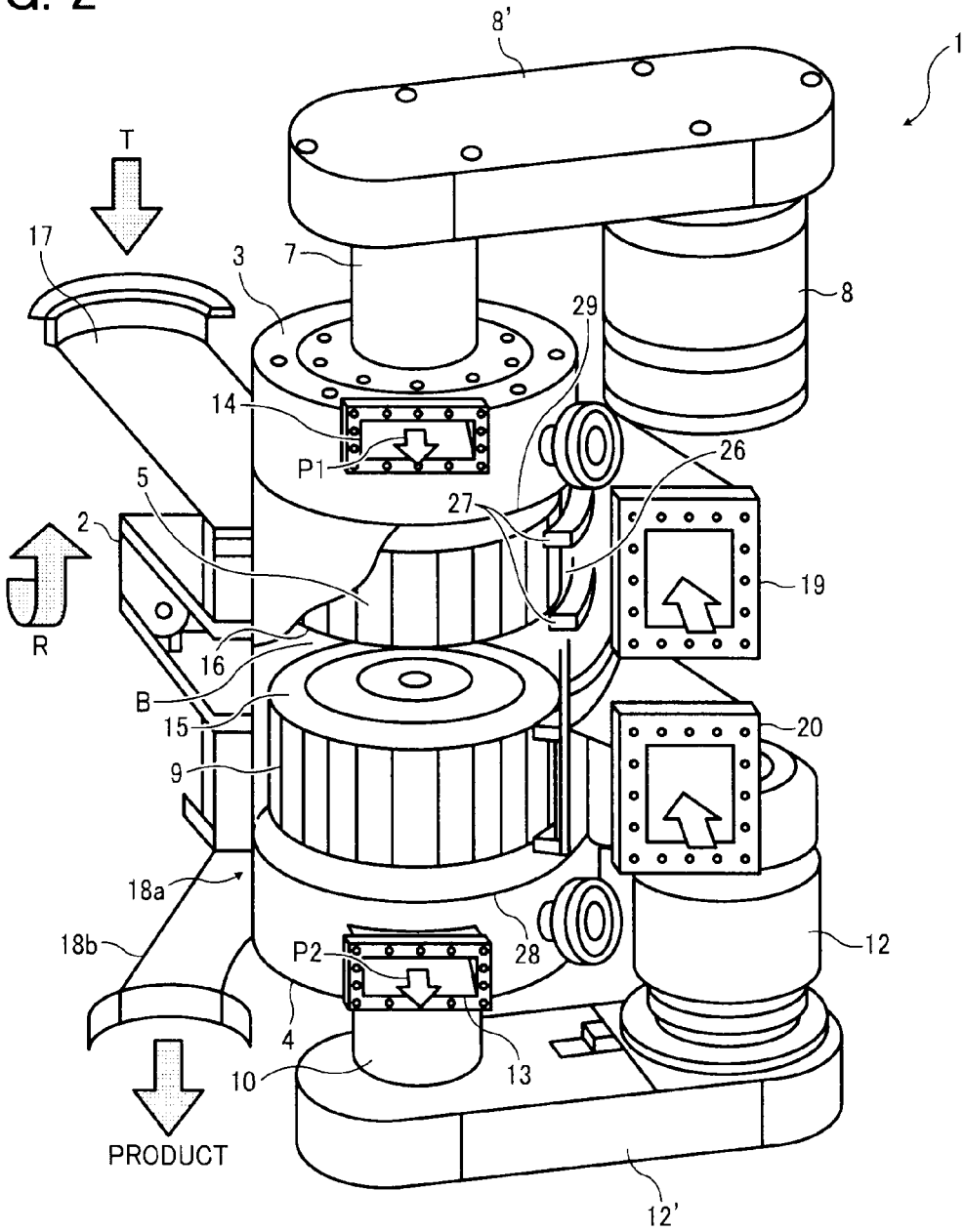
FIG. 2 is a perspective schematic view illustrating an inner structure of a tandem toner separator (TTSP)
Figure 3:
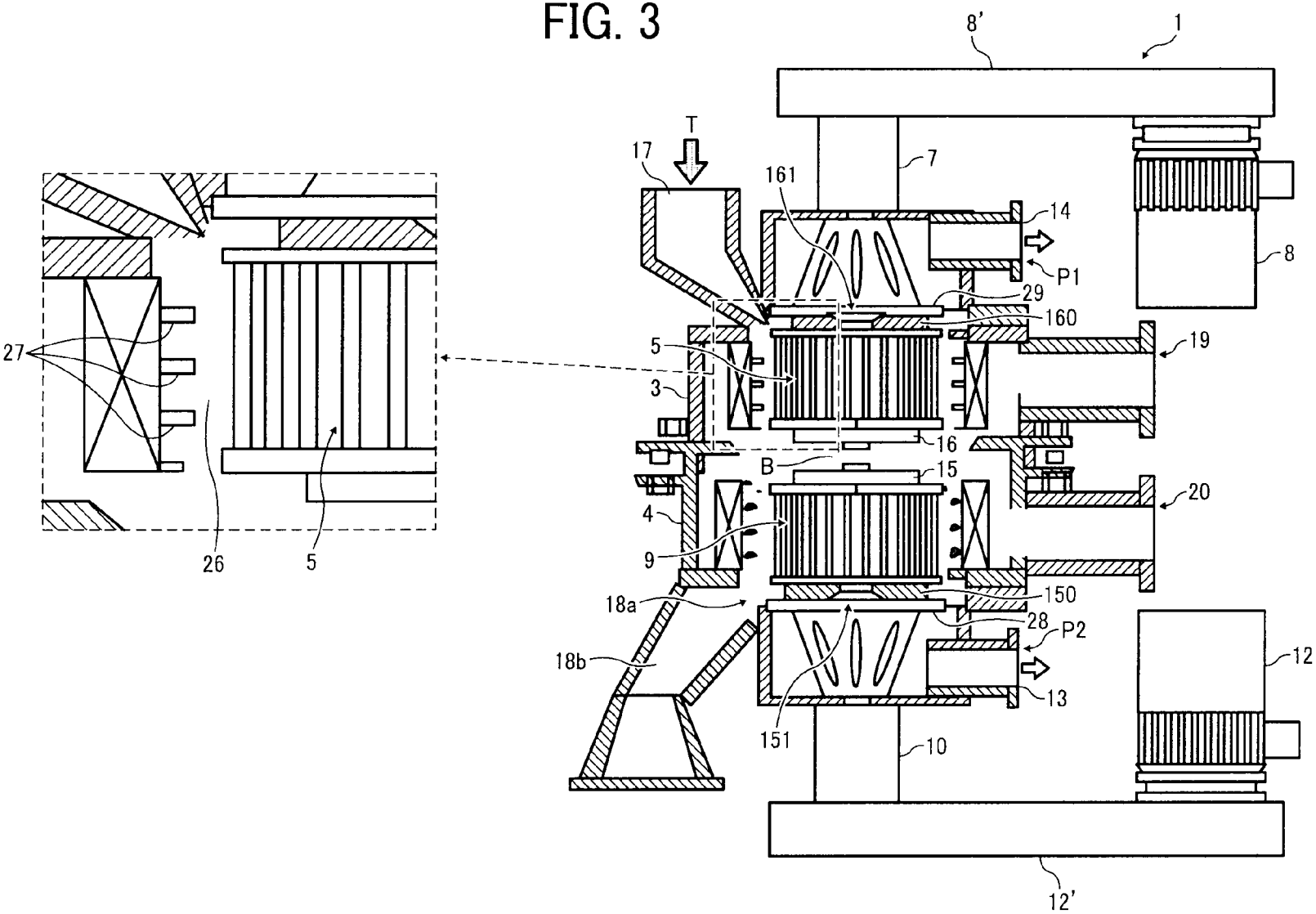
FIG. 3 is a cross-sectional schematic view illustrating an inner structure of the TTSP.
Figure 4:
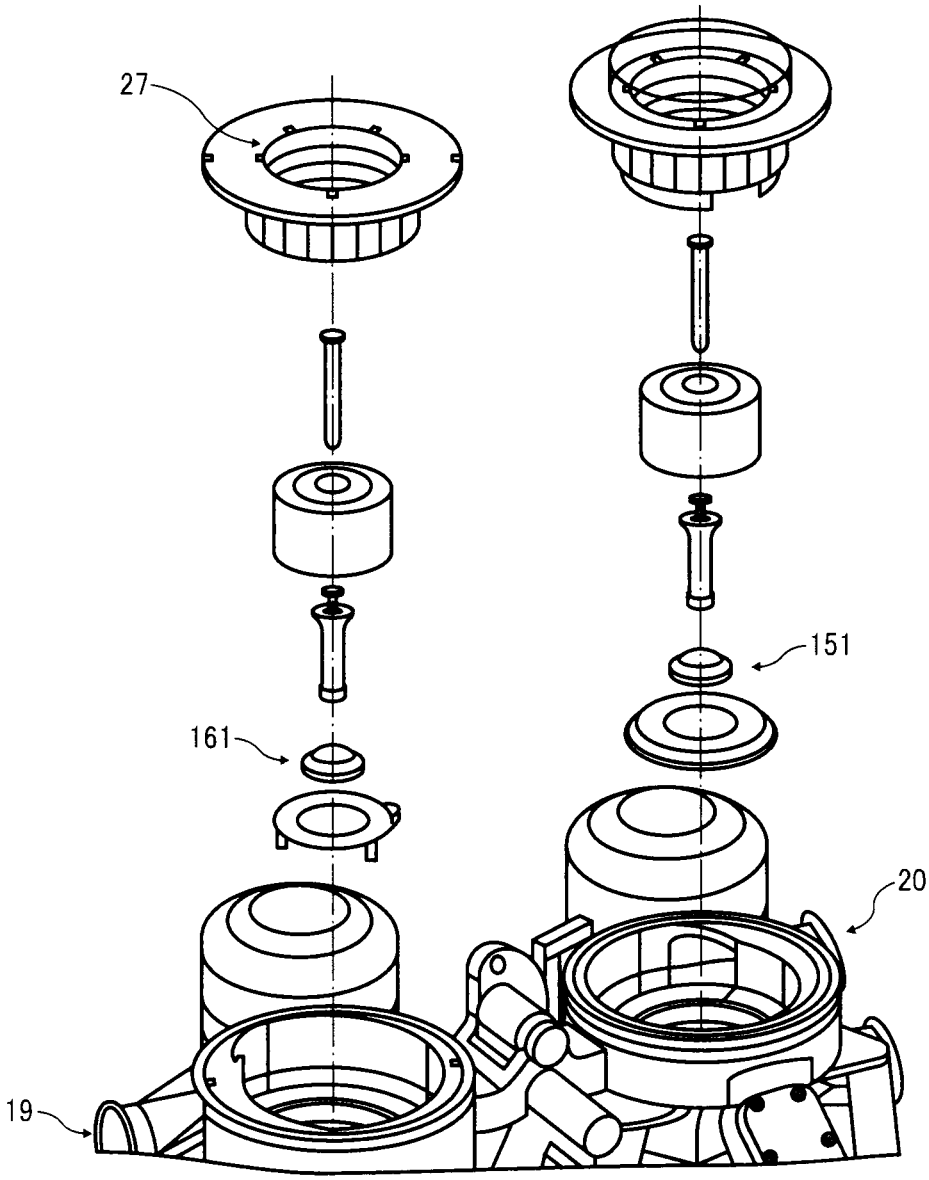
FIG. 4 is an exploded view illustrating an inner structure of the TTSP in an open state.
Figure 5:
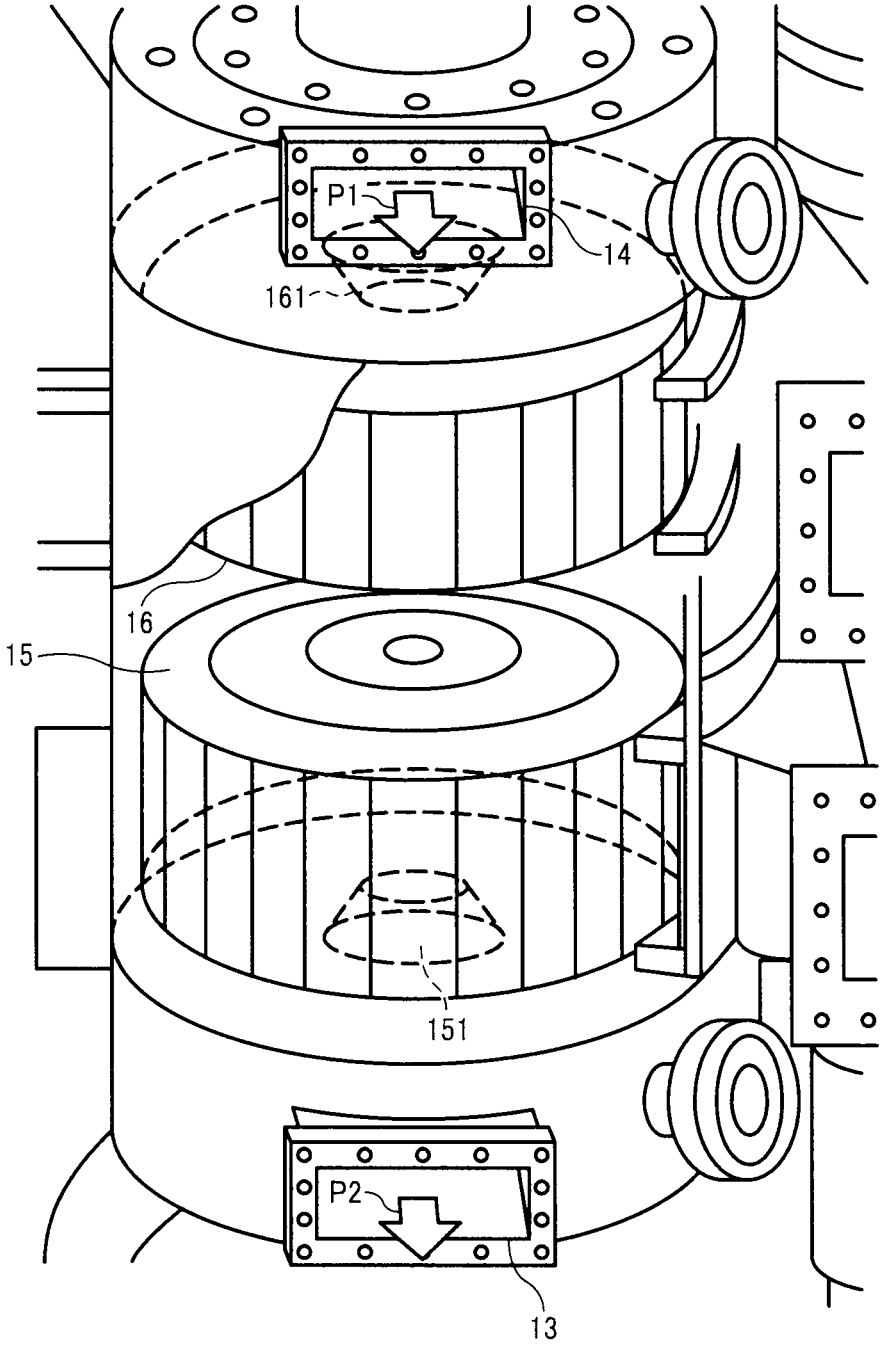
FIG. 5 is a magnified schematic view of the cutaway part in FIG. 2.
Figure 6:
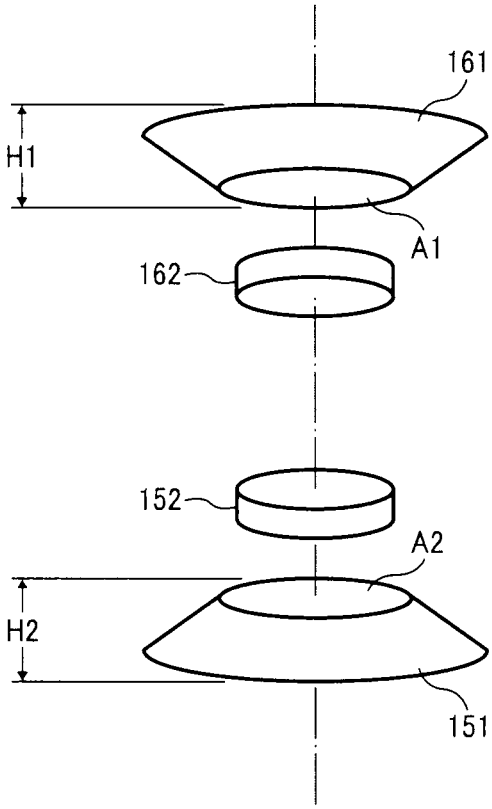
FIG. 6 is a schematic view illustrating periphery of the penetration holes in FIG. 2.

An exemplary embodiment of the present invention provides a classification device including an impeller-type classifier what is called a tandem toner separator (TTSP). FIG. 2 is a perspective schematic view illustrating an inner structure of a TTSP. FIG. 3 is a cross-sectional schematic view illustrating an inner structure of the TTSP. FIG. 4 is an exploded view illustrating an inner structure of the TTSP in an open state. FIG. 5 is a magnified schematic view of the cutaway part in FIG. 2. FIG. 6 is a schematic view illustrating periphery of the penetration holes in FIG. 2.

The TTSP illustrated in FIGS. 2 and 3 includes a single casing, within which two impeller-type classification rotors 5 and 9 are provided while one end of each of which is supported. The impeller-type classification rotors 5 and 9 are drivable by a motor and the axes thereof are coincident. The first ends of the classification rotors 5 and 9 in the axial direction are covered with a cover disc 16 without penetration hole and a cover disc 15 without penetration hole, respectively, and the second ends thereof are covered with a cover disc 160 with a penetration hole and a cover disc 150 with a penetration hole for discharging fine particles or middle-size particles, respectively. The two classification rotors 5 and 9 are provided so that the surfaces of the first ends thereof face with each other. As a result, a minute drift space is formed therebetween in the axial direction.

More specifically, referring to FIGS. 2 and 3, a classifier 1 includes a casing which is dividable and rotatable in a direction indicated by arrow R in FIG. 2 on a hinge 2. The casing includes an upper casing 3 and a lower casing 4, each including the classification rotors 5 and 9, respectively. FIGS. 2 and 3 illustrate a state in which the casing is closed. Within the upper casing 3, a drive axis 7 of the classification rotor 5 is rotatably engaged with a bearing, not shown. The classification rotor 5 is driven by a driving motor 8. The driving motor 8 is connected to the drive axis 7 and the classification rotor 5 via a transmission mechanism 8'.

Similarly, within the lower casing 4 that symmetrically faces the upper casing part 3 while their axes are coincident, a drive axis 10 of the classification rotor 9 is rotatably engaged with a bearing, not shown. The classification rotor 9 is driven by a driving motor 12. The driving motor 12 is connected to the drive axis 10 and the classification rotor 9 via a transmission mechanism 12'.

One end of each of the classification rotors 5 and 9 is supported. The drive axes 7 and 10, fine particle discharge chambers 14 and 13, and the bearings, not shown, are symmetrically provided on the upper-end side and the lower-end side of the axes, respectively. The cover disc 16 without penetration hole and the cover disc 15 without penetration hole, which are closed, are also symmetrically provided toward the center sides of the axes. Centrifugal rings 29 and 28 are also symmetrically provided toward the upper-end side and the lower-end side of the axes, respectively. The cover disc 160 with a penetration hole and the cover disc 150 with a penetration hole are also symmetrically provided toward the upper-end side and the lower-end side of the axes, respectively.

A short pipe 17 is provided above the classification rotor 5. Particles T to be classified are charged from one point on the circumference of the classification rotor 5 through the short pipe 17. An outlet short pipe **18*b* for discharging coarse particles (i.e., product particles) is provided below the classification rotor 9. Classification air is provided from classification air supply parts 19 and 20 which are opened toward the direction of the tangent lines of the circumferences of the classification rotors 5 and 9**.

Within the classifier 1, the classification rotors 5 and 9 are symmetrically facing each other while their axes are coincident. The cover disc 16 without penetration hole of the classification rotor 5 and the cover disc 15 without penetration hole of the classification rotor 9 are parallel to each other with a gap therebetween. In one embodiment, the classification rotors 5 and 9 rotate in the same direction. When the classification rotors 5 and 9 are adjusted to rotate at the same rotation number, particles are classified into fine particles and coarse particles (i.e., product particles). In this case, the fine particles are discharged from the fine particle discharge chambers 13 and 14 whereas the coarse particles (i.e., product particles) are discharged from the outlet short pipe **18*b*. Alternatively, when the classification rotors 5 and 9 are adjusted to rotate at different rotation numbers, the fine particle discharge chamber 14 discharges fine particles, the fine particle discharge chamber 13 discharges middle-size particles, and the outlet short pipe 18***b* discharges coarse particles (i.e., product particles). In another embodiment, the classification rotors 5 and 9 rotate in opposite directions. A drift space B is formed between the cover discs 16 and 15.

The classifier 1 includes a classification space 26 that is a cylindrical space in contact with the outer circumferential surface of the classification rotors 5 and 9. The classification space 26 is formed with a ring member that is provided coaxially with the classification rotors 5 and 9 forming a gap between the outer circumferential surface of the classification rotors 5 and 9. The ring member is comprised of a spiral member 27. (A spiral member for the classification rotor 9 is omitted in FIG. 2.) The spiral member 27 controls the residence time and aggregation of particles to be classified in the classification space 26. The spiral member 27 is a band-like member formed into a spiral so as to form the ring member, as illustrated in FIG. 4. The spiral member 27 is fixed on an inner circumferential surface of the upper casing 3 and/or the lower casing 4 and extends heightwise of the classification space 26. Thus, a fine gap is formed among the spiral member 27 and the classification rotors 5 and 9.

Referring to FIGS. 5 and 6, a numeral 161 denotes a penetration hole of the cover disc 160, a numeral 151 denotes a penetration hole of the cover disc 150, numerals 162 and 152 denote short pipes, P1 denotes a static pressure of an inflow air passing through the penetration hole 161, and P2 denotes a static pressure of an inflow air passing through the penetration hole 151. Referring to FIG. 6, A1 and H1 respectively denote the cross-sectional area and the height of the penetration hole 161, and A2 and H2 respectively denote the cross-sectional area and the height of the penetration hole 151.

When the diameters of the penetration holes 161 and 151 of the cover discs 160 and 150 of the upper and lower classification rotors 5 and 9, respectively, are different, centripetal forces are controllable even when centrifugal forces generated due to rotations of the classification rotors 5 and 9 are the same. As a result, classification can be performed efficiently and accurately. It can be prevented that an excessive amount of fine particles are removed at the lower classification rotor 9. It can be also prevented that product particles (i.e., desired-size particles) are immixed in fine particles. Accordingly, product particles can be collected with high accuracy and high yield.

It is preferable that the cross-sectional area A1 of the penetration hole 161 and the cross-sectional area A2 of the penetration hole 151 satisfy the formula A1>A2. It is more preferable that the formula $0.8\times A1 \leq A2 \leq 0.98\times A1$ is satisfied. When the formula A1>A2 is satisfied, centripetal force of the lower classification rotor 9 is reduced and the classification point is shifted to a small-particle-diameter side. Therefore, the peripheral speed of the classification rotors needs not to be maximized and desired-size particles can be collected at a peripheral speed of about from 40 to 60 m/s. Additionally, toner particles which are stagnating at the narrow outlet part of the base of the outlet short pipe 18*b* may be discharged more effectively, resulting in classification with high accuracy and high efficiency.

It is preferable that the static pressure P1 (kPa) of an inflow air passing through the penetration hole 161 of the cover disc 160 and the static pressure P2 (kPa) of an inflow air passing through the penetration hole 151 of the cover disc 150 satisfy the formula P1<P2. It is more preferable that the formula $P2-0.3 \leq P1 \leq P2-0.1$ is satisfied. When the formula P1<P2 is satisfied, centripetal force of the lower classification rotor 9 significantly improves, resulting in classification with high accuracy and high efficiency at low speeds. It is preferable that P2 is about from 15 to 25 kPa.

As illustrated in FIG. 6, it is preferable that the short pipes 162 and 152 are provided on the inner circumferences of the penetration holes 161 and 151, respectively. When product particles climb up through the short pipes 162 and 152 by centripetal force that passes through the penetration holes 161 and 151, the short pipes 162 and 152 may prevent the product particles from returning to the bulk of fine particles. The short pipes 162 and 152 preferably have a height of about 1 to 25 mm.

It is preferable that the height H1 of the penetration hole 161 and the height H2 of the penetration hole 151 satisfy the formula H1>H2. It is more preferable that the formula $1.1\times H2 \leq H1 \leq 1.3\times H2$ is satisfied. When the formula H1>H2 is satisfied, product toner particles may be discharged from the outlet short pipe 18*b* that is provided below the classification rotor 9. As a result, the toner concentration increases at the periphery of the upper classification rotor 5, preventing the product toner particles from passing through the upper penetration hole 161. This may result in classification with high accuracy and high yield. The height H1 is preferably about 5 to 50 mm, and more preferably about 15 to 35 mm.

It is preferable that a minus static pressure PS1 (kPa) at a vicinity of a classifier outlet part 18*a* and a minus static pressure PS2 (kPa) at the outlet short pipe 18*b* satisfy the formula PS1<PS2. In other words, the suction pressure of the outlet pipe is lower than the inner pressure of the classifier. It is more preferable that the formula $PS2-0.4 \leq PS1 \leq PS2-0.05$ is satisfied.

When the formula PS1<PS2 is satisfied, the suction pressure within the outlet short pipe 18*b* increases and the classified toner particles are smoothly discharged from the outlet short pipe 18*b*, effectively preventing adhesion of the toner particles. To satisfy the formula PS1<PS2, for example, the outlet short pipe 18*b* may be connected to a hose to be sucked. The minus static pressure PS2 is preferably about −0.05 to −0.4 kPa.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following examples, particle diameter distributions of toners are measured using a particle size measuring instrument such as COULTER COUNTER TA-II and COULTER MULTISIZER III (both from Beckman Coulter K. K.).

First, 0.1 to 5 ml of a surfactant (preferably an alkylbenzene sulfonate) is contained in 100 to 150 ml of an electrolyte as a dispersing agent. The electrolyte is a 1% NaCl aqueous solution which is prepared from a first grade sodium chloride, such as ISOTON-II (from Beckman Coulter K. K.). Next, 2 to 20 mg of toner particles are added to the electrolyte to prepare a toner suspension. The toner suspension is subjected to a dispersion treatment using an ultrasonic dispersing machine for about 1 to 3 minutes. The toner suspension is then subjected to a measurement of the volume and the number of the toner particles using the above-described measuring instrument with an aperture of 100 μm to determine the volume distribution and the number distribution. The weight average particle diameter (D4) and the number average particle diameter (D1) are calculated from the volume distribution and the number distribution.

Channels include the following 13 channels: 2.00 or more and less than 2.52 μm; 2.52 or more and less than 3.17 μm; 3.17 or more and less than 4.00 μm; 4.00 or more and less than 5.04 μm; 5.04 or more and less than 6.35 μm; 6.35 or more and less than 8.00 μm; 8.00 or more and less than 10.08 μm; 10.08 or more and less than 12.70 μm; 12.70 or more and less than 16.00 μm; 16.00 or more and less than 20.20 μm; 20.20 or more and less than 25.40 μm; 25.40 or more and less than 32.00 μm; and 32.00 or more and less than 40.30 μm. Namely, particles having a particle diameter of 2.00 μm or more and less than 40.30 μm can be measured. Particles having a particle diameter of 2.00 μm or less are measured using an instrument FPIA-2100 (from Sysmex Corporation).

Examples 1 to 6 and Comparative Example 1

(Preparation of Toner)

A mixture of 82 parts of a polyester resin (i.e., a binder resin), 2 parts of a zinc salt of 3,5-di-t-butylsalicilic acid (i.e., a charge controlling agent), 5 parts of a carnauba wax (i.e., a release agent), and 10 parts of a carbon black (i.e., a colorant) is melt-kneaded using a double-axis kneader and the melt-kneaded mixture is cooled to be solidified. The solidified mixture is pulverized into coarse particles, which are a raw material of a toner.

Next, 600 kg of the raw material are pulverized into particles, which are to be classified, using a jet mill. The particles have a weight average particle diameter (D4) of 4.70 μm and include particles with a particle diameter of 4 μm or less in an amount of 87.0% by number. The ratio (D4/D1) of the weight average particle diameter (D4) to the number average particle diameter (D1) is 1.33.

Next, 200 kg of the particles are subjected to a continuous classification treatment under the conditions in which a rotor peripheral speed is 58 m/sec or 62 m/sec and an input is 60 kg/h, so that the ratio (D4/D1) of the resultant classified particles becomes 1.28. The conditions and results of the classification treatment are shown in Table 1.

TABLE 1

| | | Ex. 1 | Ex. 2 | Ex. 3 | Ex. 4 | Ex. 5 | Ex. 6 | Comp. Ex. 1 |
|---|---|---|---|---|---|---|---|---|
| Peripheral Speed (m/s) | Upper Rotor | 62 | 58 | 58 | 58 | 58 | 58 | 62 |
| | Lower Rotor | 62 | 58 | 58 | 58 | 58 | 58 | 62 |
| Cross Sectional Area Ratio of Penetration Holes | Upper (A1) | 1.00 | 1.00 | 1.00 | 1.00 | 1.00 | 1.00 | 1.00 |
| | Lower (A2) | 0.99 | 0.97 | 0.97 | 0.97 | 0.97 | 0.97 | 1.00 |
| Height of Short Pipes (mm) | Upper | — | — | — | 10.0 | 10.0 | 10.0 | — |
| | Lower | — | — | — | 10.0 | 10.0 | 10.0 | — |
| Height of Penetration Holes (mm) | Upper (H1) | 25.0 | 25.0 | 25.0 | 25.0 | 30.0 | 30.0 | 25.0 |
| | Lower (H2) | 25.0 | 25.0 | 25.0 | 25.0 | 25.0 | 25.0 | 25.0 |
| Static Pressures (kPa) | Upper (P1) | −20 | −20 | −20 | −20 | −20 | −20 | −20 |
| | Lower (P2) | −20 | −20 | −22 | −22 | −22 | −22 | −20 |
| Suction Pressure at Outlet (KPa) | | — | — | — | — | — | −0.1 | — |
| D4 (μm) of Classified Particles | | 4.9 | 4.9 | 4.9 | 4.9 | 4.9 | 4.9 | 4.95 |
| Particles with Diameter of 4 μm or less (% by number) | | 84.0 | 85.0 | 87.0 | 87.0 | 88.0 | 89.0 | 82.0 |
| Particles with Diameter of 2 μm or less (% by number) | | 15.0 | 12.0 | 10.0 | 9.0 | 8.0 | 8.0 | 22.0 |
| Classification Yield (%) | | 82.0 | 84.0 | 87.0 | 88.0 | 89.0 | 89.5 | 80.0 |

It is apparent from Table 1 that the classification device of the present invention provides reliable classification.

Image Evaluation 1

To prepare a toner A, 100 parts of the particles classified in Example 1 are mixed with 0.2 parts of silica particles and 0.2 parts of titanium oxide particles using a HENSCHEL MIXER, followed by sieving. To prepare a two-component developer A, 5 parts of the toner A are mixed with 95 parts of a silicone-coated carrier having a weight average particle diameter of 55 μm using a TURBULA MIXER.

The two-component developer A is set in an image forming apparatus IMAGIO MP 4000 (from Ricoh Co., Ltd.) to produce an image. The resulting image is very sharp and smooth.

Image Evaluation 2

To prepare a toner B, 100 parts of the particles classified in Comparative Example 1 are mixed with 0.2 parts of silica particles and 0.2 parts of titanium oxide particles using a HENSCHEL MIXER, followed by sieving. To prepare a two-component developer B, 5 parts of the toner B are mixed with 95 parts of a silicone-coated carrier having a weight average particle diameter of 55 μm using a TURBULA MIXER.

The two-component developer B is set in an image forming apparatus IMAGIO MP 4000 (from Ricoh Co., Ltd.) to produce an image. The resulting image has poor sharpness and granularity.

This document claims priority and contains subject matter related to Japanese Patent Application No. 2008-308889, filed on Dec. 3, 2008, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A classification device for classifying particles by size, comprising:

an upper impeller-type rotor, a lower end of which is covered with a cover disc without penetration hole and an upper end of which is covered with an upper cover disc with a first frustoconical penetration hole;

a lower impeller-type rotor, an upper end of which is covered with a cover disc without penetration hole and a lower end of which is covered with a lower cover disc with a second frustoconical penetration hole, the lower cover disc with the second frustoconical penetration hole being disposed below the upper impeller-type rotor and the lower impeller-type rotor;

an upper particle discharge chamber configured to discharge particles of a first size from the upper impeller-type rotor;

a lower particle discharge chamber disposed below the upper particle discharge chamber, and configured to discharge particles of a second size from the lower impeller-type rotor; and an outlet pipe provided below the lower impeller-type rotor and configured to discharge particles of a size larger than the first and second sizes, wherein the upper impeller-type rotor and the lower impeller-type rotor are provided so that axes thereof are coincident and the first ends face with each other forming a gap therebetween in an axial direction, wherein the penetration holes of the upper cover disc and the lower cover disc extend through an entire thickness of the upper cover disc and the lower cover disc, respectively, wherein a diameter of the first frustoconical penetration hole increases from an upper surface of the upper cover disc to a lower surface of the upper cover disc in the axial direction, and a diameter of the second frustoconical penetration hole increases from a lower surface of the lower cover disc to an upper surface of the lower cover disc in the axial direction, and wherein diameters of the penetration holes of the upper cover disc and the lower cover disc are different.

2. The classification device according to claim 1, wherein a cross-sectional area A1 of the first frustoconical penetration hole at lower surface of the upper cover disc and a cross-sectional area A2 of the second frustoconical penetration hole at the upper surface of the lower disc satisfy the formula A1>A2.

3. The classification device according to claim 2, wherein a static pressure P1 of an inflow air passing through the first frustoconical penetration hole of the upper cover disc and a static pressure P2 of an inflow air passing through the second frustoconical penetration hole of the lower cover disc satisfy the formula P1<P2.

4. The classification device according to claim 2, wherein the first frustoconical penetration hole of the upper cover disc and the second frustoconical penetration hole of the lower cover disc are equipped with short pipes.

5. The classification device according to claim 2, wherein a height H1 of the first frustoconical penetration hole of the upper cover disc and a height H2 of the second frustoconical penetration hole of the lower cover disc satisfy the formula H1>H2.

6. The classification device according to claim 2, further comprising:

an outlet, wherein the outlet pipe discharges desired-size particles from the outlet, and a minus static pressure PS1 at the outlet and a minus static pressure PS2 at the outlet pipe satisfy the formula PS1<PS2.

7. The classification device according to claim 2, wherein the formula $0.8\times A1 \leq A2 \leq 0.98\times A1$ is satisfied.

8. The classification device according to claim 1, wherein a static pressure P1 of an inflow air passing through the first frustoconical penetration hole of the upper cover disc and a static pressure P2 of an inflow air passing through the second frustoconical penetration hole of the lower cover disc satisfy the formula P1<P2.

9. The classification device according to claim 1, wherein the first frustoconical penetration hole of the upper cover disc and the second frustoconical penetration hole of the lower cover disc are equipped with short pipes.

10. The classification device according to claim 1, wherein a height H1 of the first frustoconical penetration hole of the upper cover disc and a height H2 of the second frustoconical penetration hole of the lower cover disc satisfy the formula H1>H2.

11. The classification device according to claim 1, further comprising:

an outlet, wherein the outlet pipe discharges desired-size particles from the outlet, and a minus static pressure PS1 at the outlet and a minus static pressure PS2 at the outlet pipe satisfy the formula PS1<PS2.

12. The classification device according to claim 1, wherein the first size and the second size are equal to each other.

13. The classification device according to claim 1, wherein the second size is greater than the first size.

14. The classification device according to claim 1, wherein the first and second sizes are based on the diameters of the penetration holes of the upper cover disc and the lower cover disc.

15. The classification device according to claim 1, wherein centers of the penetration holes of the upper cover disc and the lower cover disc are aligned in an axial direction of the upper impeller-type rotor and the lower impeller-type rotor.

16. The classification device according to claim 1, wherein the upper cover disc and the lower cover disc cover the upper impeller-type rotor and the lower impeller-type rotor, respectively, in a direction perpendicular to the axial direction of the upper impeller-type rotor and the lower impeller-type rotor, and the penetration holes of the upper cover disc and the lower cover disc extend through the upper cover disc and the lower cover disc, respectively, in the axial direction of the upper impeller-type rotor and the lower impeller-type rotor.

17. The classification device according to claim 1, wherein the particles are toner particles.

* * * * *